US005380964A

United States Patent [19]

Easton et al.

[11] Patent Number: 5,380,964

[45] Date of Patent: Jan. 10, 1995

[54] SWITCH ASSEMBLY

[75] Inventors: David J. Easton, Cedar Falls, Iowa; Carl R. Thompson, Stratford, Conn.; Corwin L. Klages, Cedar Falls, Iowa

[73] Assignee: Deere & Company, Moline, Ill.

[21] Appl. No.: 136,854

[22] Filed: Oct. 18, 1993

[51] Int. Cl.[6] ..... H01H 27/10

[52] U.S. Cl. ..... 200/43.01; 200/43.015; 200/43.016; 200/43.018

[58] Field of Search ..... 200/43.01, 43.13, 43.16, 200/43.18, 553, 557, 558, 520, 318, 327, 339, 341, 43.17, 334, 556, 43.11; 74/142, 149, 145, 479 ML; 70/DIG. 30; 292/64, 67

[56] References Cited

U.S. PATENT DOCUMENTS

| | | | |
|---|---|---|---|
| 3,678,229 | 7/1972 | Osika | 200/43.01 |
| 4,947,009 | 8/1990 | Osika et al. | 200/43.16 |
| 5,045,648 | 9/1991 | Fogleman, Sr. | 200/43.16 |
| 5,095,181 | 3/1992 | Osika et al. | 200/43.16 |

OTHER PUBLICATIONS

Delta Systems, Inc. "P.T.O. Switch Proposal" Feb. 20 1991.

Deere & Company, "Switch, Rotary" Mar. 18, 1993.

Deere & Company, "Switch, Toggle, Momentary, Three Position" Feb. 11, 1988.

Deere & Company, "Switch Ass'y, Toggle" Jan. 28, 1986.

*Primary Examiner*—Henry J. Recla
*Assistant Examiner*—David J. Walczak

[57] ABSTRACT

A control switch assembly includes a housing having a base with an opening and a pair of side walls on opposite sides of the opening. An actuator member is rotatably mounted in the opening and has a body which forms a pocket. The pocket is open at one end and has a partially cylindrical bottom surface. A lever includes a body at least partially received by the pocket, an arm projecting from the body and an abutment surface. The body has a slot extending therethrough parallel to the pivot pin. The slot is elongated along an plane which is perpendicular to the pivot pin axis so that the pivot pin is slidably and rotatably received by the slot. The lever is slidable with respect to the pivot pin from a raised position wherein the body of the lever is spaced apart from the bottom surface of the pocket to a depressed position wherein the body of the lever engages the bottom surface of the pocket. A pair of springs are biassed to urge the lever to its raised position. A stop member projects from the housing and is engagable with the lever abutment surface to prevent pivoting of the lever in a first direction when the lever is in its raised position. The lever abutment surface being positioned to avoid engagement with the stop member as the lever is rotated in the first direction from its depressed position.

15 Claims, 3 Drawing Sheets

SWITCH ASSEMBLY

BACKGROUND OF THE INVENTION

The invention relates to a manually operable switch assembly.

It is well known to use switches to control electrically operated functions used on vehicles. For example, commercially available rocker switches and toggle switches are commonly used in vehicle applications. Such standard switches can be actuated with a simple application of a force in a single direction. Such a simple actuation process increases the possibility of accidental actuation relative to a more complex actuation process. Accordingly, to reduce the likelihood of inadvertent operation, switch assemblies have been designed which require dual motion actuation. For example, some agricultural tractors with a three point hitch control are provided with a "bat handle" switch mounted on the rear of the left fender. With such a switch, the bat must be pulled out before it can be actuated toward an ON position. It is also known to provide a switch with a knob which must be lifted before it can be rotated. Many such dual motion switches require non-intuitive manipulations which reduce their convenience. Accordingly, it would be desirable to provide a dual motion switch which can be easily and intuitively operated. It would also be desirable to provide such a dual motion switch which can interface with standard electrical switch components.

SUMMARY OF THE INVENTION

An object of this invention is to provide a switch assembly which is designed to reduce the likelihood of inadvertent switch actuation.

Another object of this invention is to provide such a switch assembly which is simple and intuitive to operate.

Another object of this invention is to provide such a switch assembly which can interface with standard electrical switch components.

These and other objects are achieved by the present invention, wherein a switch assembly includes a housing having a base with an opening and a pair of side walls on opposite sides of the opening. An actuator member is rotatably mounted in the opening and has a body which forms a pocket. The pocket is open at one end and has a partially cylindrical bottom surface. An arm projects from the body for engaging an element of a standard rocker type electrical switch. A lever includes a body at least partially received by the pocket, an arm projecting from the lever body and an abutment surface. The body has a slot extending therethrough parallel to the pivot pin. The slot is elongated along an plane which is perpendicular to the pivot pin axis so that the pivot pin is slidably and rotatably received by the slot. The lever is slidable with respect to the pivot pin from a raised position wherein the lever body is spaced apart from the bottom surface of the pocket to a depressed position wherein the lever body engages the bottom surface of the pocket. Two springs are biassed to urge the lever to its raised position. A stop member projects from the housing and is engagable with the lever abutment surface to prevent pivoting of the lever in a first direction when the lever is in its raised position. The lever abutment surface being positioned to avoid engagement with the stop member as the lever is rotated in the first direction from its depressed position.

DETAILED DESCRIPTION

Figure 1:
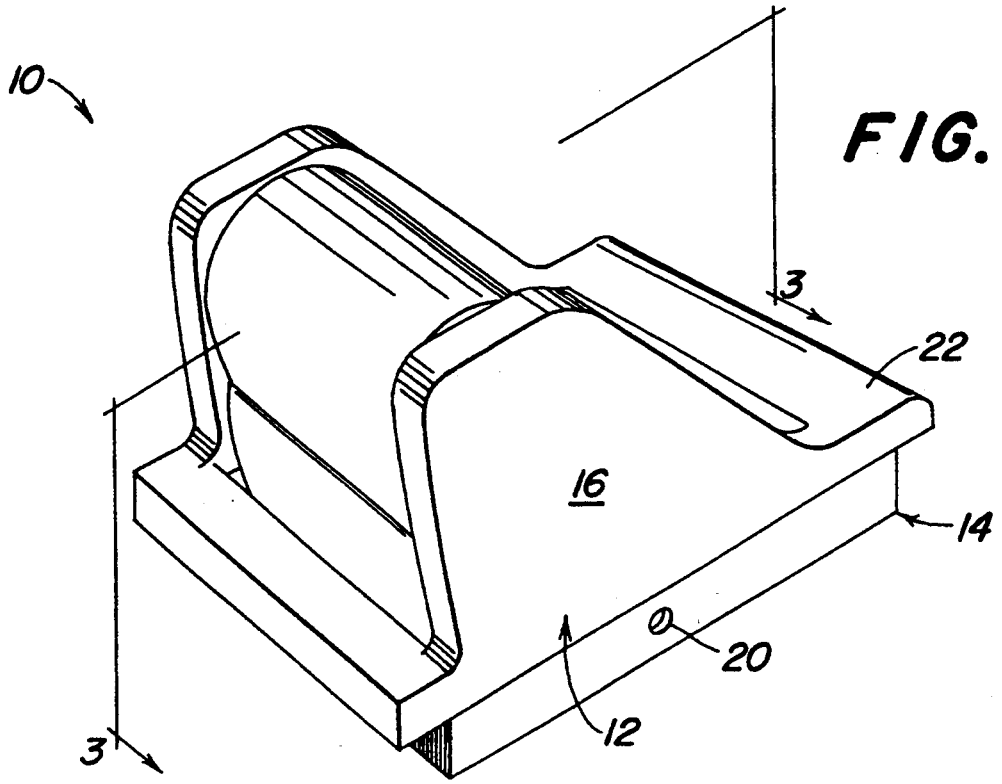
FIG. 1 is an assembly perspective view of a control switch assembly according to the present invention.

Referring to FIG. 1, a switch assembly 10 includes a housing or bezel 12 having a base 14 which surrounds a generally rectangular shaped opening 15. A pair of side walls 16 and 18 project from opposite sides of the base 14. A bore 20 extends through both sides of the base 14. A platform 22 extends across an upper side of one end (viewing FIG. 3) of the base 14 from one side wall 16 to the other side wall 18. Platform 22 has a substantially flat main central portion 24 and an upwardly slanted inner edge 26. On the other end of the base 14 a platform 30 extends across an upper side of the other end (viewing FIG. 3) of the base 14 from one side wall 16 to the other side wall 18. Platform 30 has a substantially flat outer half 32 with a bevelled outer edge and an upwardly slanted inner half 34. Inner half 34 has a slight curvature centered on the axis of bore 20.

Figure 4:
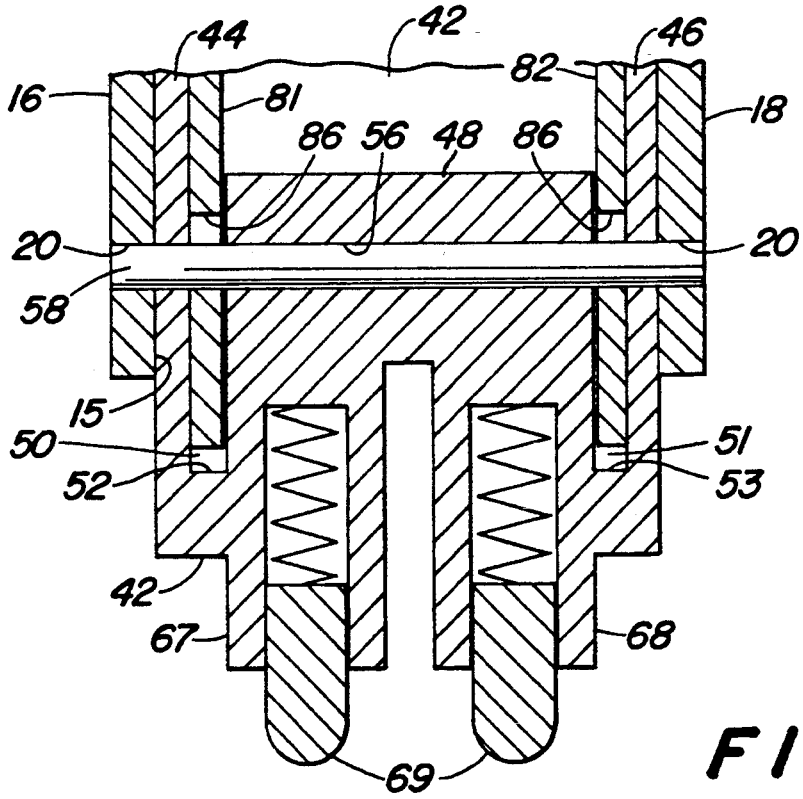
FIG. 4 is a sectional view along lines 4—4 of FIG. 3.
Figure 2:
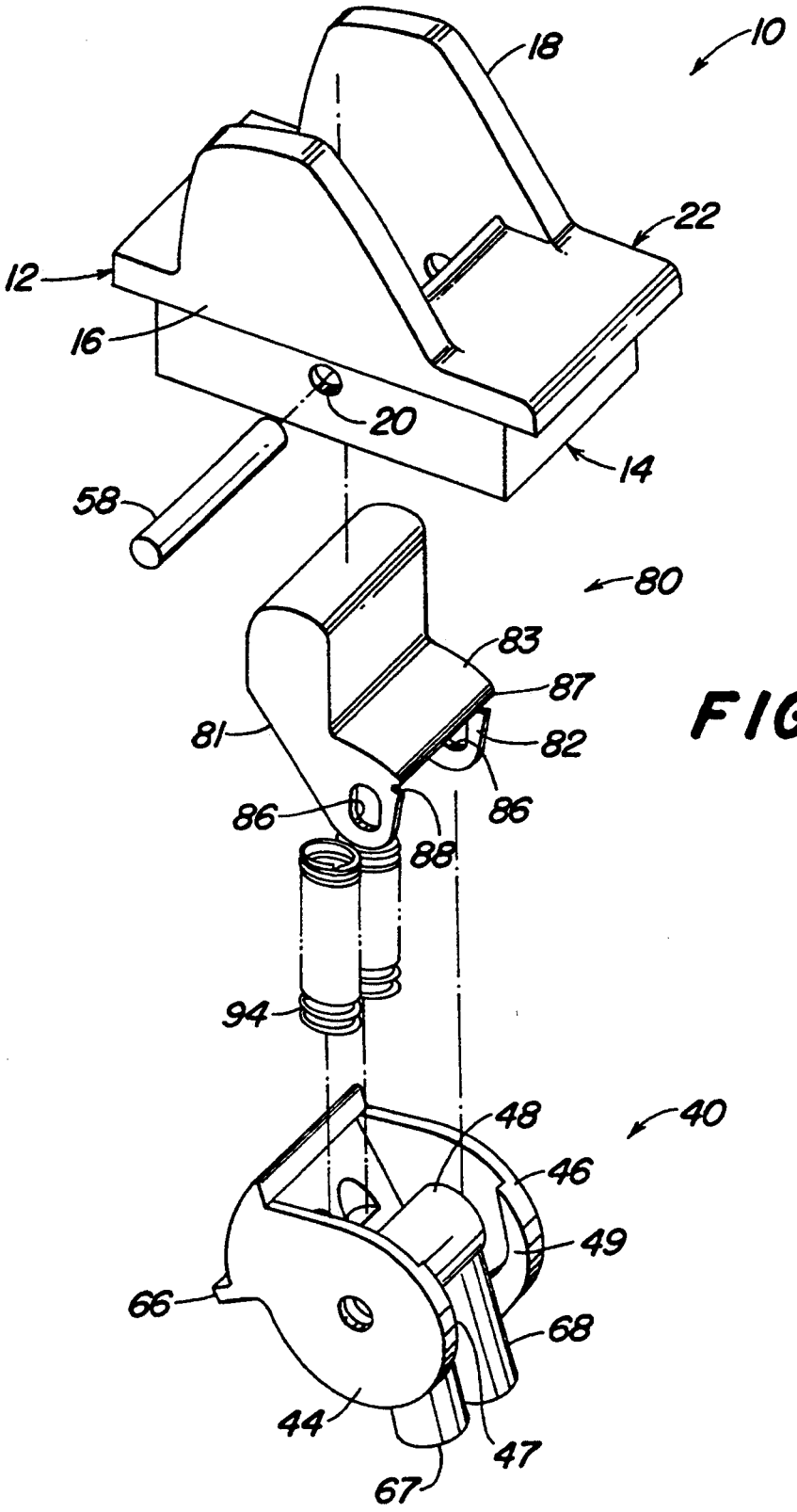
FIG. 2 is an exploded perspective view of a control switch assembly according to the present invention.

A subactuator 40 is pivotally mounted in the bezel 12 in the opening in the base 14 and between the side walls 16 and 18. The subactuator 40 has a pair of spaced apart side walls 44 and 46 joined together by a body 42. A pair of curved ridges 47 and 49 are formed on the inside of the lower edges of the side walls 44 and 46, respectively. The subactuator 40 also has a cylindrical hub 48. As best seen in FIG. 4, the ends of the hub 48 are spaced apart from the side walls 44 and 46. The hub is rigidly connected to the ridges 47 and 49 and to the side walls 44 and 46 by a pair of hollow cylindrical members 67 and 68 which project from the body 42. The hub 48, the side walls 44 and 46 and the ridges 47 and 49 form pockets 50 and 51 which have curved bottom surfaces 52 and 53. A bore 56 extends through the side walls 44 and 46, the hub 48 and pockets 50 and 51. A pin 58 extends through bores 56 and 20 and thereby pivotally holds the subactuator 40 in place in the bezel 12. A pair of parallel blind spring bores 60 and 62 extend downwardly part way into a slanted inner surface 64 formed by the body 42. The bores 60 and 62 are positioned between the side walls 44 and 46 and between the bore 56 and an upper edge of surface 64 and end wall 48. A lip 66 projects from a lower end of the curved end wall 48. The lip 66 is engagable with the underside of platform 30 to limit the counter-clockwise pivoting of the subactuator 40 viewing FIG. 3.

Figure 3:
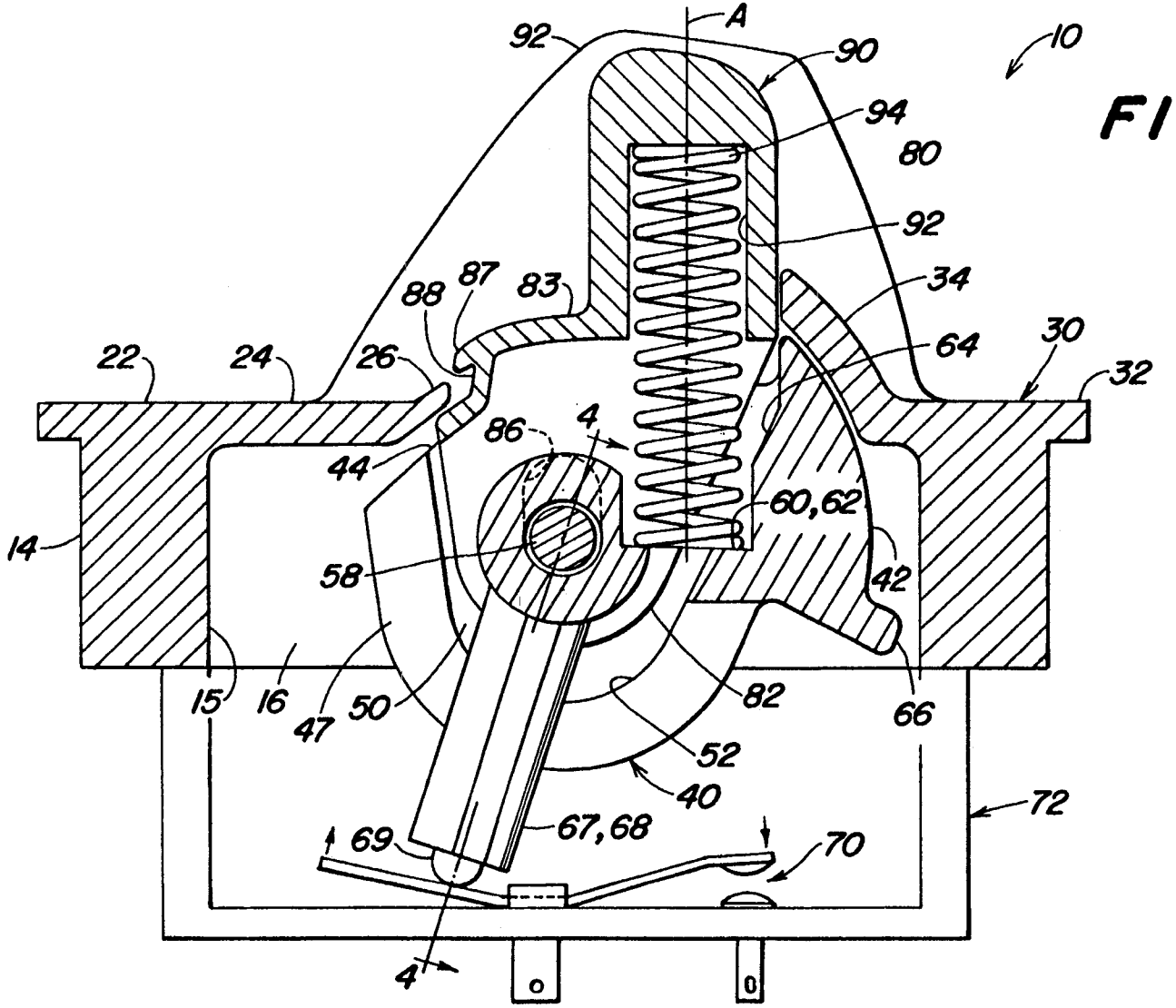
FIG. 3 is a cross sectional side view of the present invention along lines 3—3 of FIG. 1.

The hollow cylindrical members 67 and 68 extend generally downwardly and slightly to the left (viewing FIG. 3). Member 67 and 68 are located side-by-side between the side walls 46 and 48 and extend from the hub 48 to a position beyond the curved body 42. Members 67 and 68 receive spring biased pins 69 which are operatively engagable with parts of a rocker switch 72, such as is commercially available from Eaton/Cutler-Hammer. Preferably, the upper parts of the rocker switch 72, including the upper portion of its housing (not shown) and the manually actuated rocker element (not shown) are removed so that the spring biased pins 69 can engage the pivotal metallic switch elements 70 which are located in the interior of the rocker switch 72.

A lever 80 is mounted in the bezel 12 and is coupled to the subactuator 40. The lever 80 has a pair of spaced apart side walls 81 and 82 joined together by top wall 83. When the lever 80 is assembled to the subactuator 40, the side walls 81 and 82 are positioned in the space between the ends of the hub 48 and the corresponding side walls 44 and 46 of the subactuator 40. The lower edges of side walls 81 and 82 are smoothly curved to match the curve of the inner surface of the curved body 42 of subactuator 40. Slots 86 extends through the side walls 81 and 82. The slots 86 have an elongated cross-sectional shape with cylindrical top and bottom surfaces joined by vertically extending flat side walls. The slots 86 receive the pin 58 so that the lever 80 may pivot about the pin 58 and so that the lever 80 may slide with respect to the pin 58 in a direction parallel to the orientation of the slot 86. The top wall 83 forms a lip 87 and a notch 88 which opens towards the edge 26 of the bezel 12.

The lever 80 has an arm 90 which can be manipulated by a human operator. The arm 90 extends from the top wall 83 and between the side walls 16 and 18 to a curved top surface 92 which is closely aligned with the upper edges of the housing side walls 16 and 18. A pair of downwardly opening blind spring bores 92 extend upwardly into the arm 90. A pair of coils springs 94 are mounted in the bores 92 and are biassed to urge the lever 80 upwardly viewing FIG. 3 and away from the bottom surface 52 of pocket 50.

As best seen in FIG. 3, the central longitudinal axis A of the arm 90 is generally parallel to and spaced apart from the axis of elongation of the slot 86 and is positioned between the pin 58 and the inner half 34 of the platform 30. As a result, a torque applied to the lever 80 as a result of a downward force on the arm 90 will tend to rotate the lever 80 in a clock-wise direction into engagement with the inner half 34 of the platform 30, which is opposite to the counter-clockwise direction required to toggle the switch 72. This prevents a simple downward force or motion from toggling the switch 72 on.

If the lever 80 is rotated by a few degrees counter-clockwise from the position shown in FIG. 3, the edge 26 of the bezel 12 will engage the bottom surface of notch 88 and prevent further counter-clockwise rotation thereof. Before the lever 80 can be fully rotated in the counter-clockwise direction, the lever 80 must first be pushed downwardly, viewing FIG. 3, compressing the springs 94 and utilizing the free play between the elongated slots 86 and the pin 58. This causes the lip 87 to be depressed below the lower surface of edge 26 and causes the lever side walls 81 and 82 to move close to or into engagement with the body 42 of the subactuator 40. Thereafter, the subactuator 40 will rotate along with the lever 80, and the lever 80, together with the subactuator 40 can be rotated in the counter-clockwise direction to toggle the switch 72. The lever 80 and the subactuator 40 can be rotated in the counter-clockwise direction until the lip 66 engages the underside of platform 30.

Thus, the lever 80 must first be moved downwardly before it can then be fully rotated in the counter-clockwise direction to toggle the switch 72 on. It is unlikely that both such motions would be accidentally performed by an operator. Preferably, the rocker switch 72 is oriented with respect to the switch assembly 10 similar to what is shown in FIG. 3, so that the initial downward movement of the lever 80 will not cause a toggling of the switch 72 on and so that only the rotation of the lever 80 and the subactuator 40 will cause a toggling of the switch 72 on.

In order to toggle the switch 72 off from its on position, only a single manual manipulation need be applied to the lever 80. In particular, the switch 72 can be toggled off merely by rotating the lever 80 clockwise viewing FIG. 3. This same motion also places the lever back in its initial position which prevents inadvertent turning on of the switch 72. Thus, a manually applied dual motion is required to toggle the switch 72 on, and a manually applied single motion is sufficient to toggle the switch 72 off.

While the present invention has been described in conjunction with a specific embodiment, it is understood that many alternatives, modifications and variations will be apparent to those skilled in the art in light of the foregoing description. Accordingly, this invention is intended to embrace all such alternatives, modifications and variations which fall within the spirit and scope of the appended claims.

What is claimed is:

1. A switch assembly comprising:

a housing having a base having an opening therein;

an actuator member mounted in the opening and rotatably coupled to the housing, the actuator having a body forming a pocket therein, the pocket being open at one end thereof and having a bottom surface;

a coupling member for coupling the actuator member to electrical switch contacts;

a lever having a lever body at least partially received by the pocket, a manually operated arm projecting from the lever body and an abutment surface, the lever body being slidably and rotatably coupled to the housing, the lever body being slidable from a raised position wherein the lever body is spaced apart from the bottom surface of the pocket to a depressed position wherein the lever body engages the bottom surface of the pocket;

a spring biassed to urge the lever to its raised position;

a stop member mounted on the housing, the stop member being engagable with the lever abutment surface to prevent pivoting of the lever in a first direction when the lever is in its raised position, the lever abutment surface being positioned to avoid engagement with the stop member as the lever is rotated in the first direction from its depressed position.

2. The switch assembly of claim 1, wherein:

a pivot pin is received by bores in the housing;

the actuator member has bores which rotatably receive the pivot pin; and the lever body has a slot extending therethrough parallel to an axis of the pivot pin, the slot being elongated along an plane of elongation which is perpendicular to the pivot pin axis, the pivot pin being slidably and rotatably received by the slot.

3. The switch assembly of claim 2, wherein:

a notch is formed in a surface of the lever, the notch extending parallel to the pivot pin, a bottom surface of the notch forming the lever abutment surface.

4. The switch assembly of claim 2, wherein:

the arm has a central axis which is spaced apart to one side of the axis of elongation of the slot so that a force applied to the lever to move it to its depressed position will generate a torque which tends to rotate the lever and the actuator member in a direction opposite to the first direction.

5. The switch assembly of claim 1, wherein:

the arm has a central axis which is spaced apart to one side of an axis rotation of the actuator member so that a force applied to the lever to move it to its depressed position will generate a torque which tends to rotate the lever and the actuator member in a direction opposite to the first direction.

6. The switch assembly of claim 5, wherein:

a lip projects from the actuator member, the lip being engagable with a portion of the housing to limit pivoting of the lever in the first direction.

7. The switch assembly of claim 1, wherein:

a stop arm projects from the housing, an end of the stop arm being engagable with the lever to prevent pivoting of the lever in a second direction.

8. The switch assembly of claim 1, wherein:

a lip projects from the actuator member, the lip being engagable with the stop arm to limit pivoting of the lever in the first direction.

9. The switch assembly of claim 1, wherein:

a first platform extends across one end of the base, an edge of the first platform forming the stop member; and a second platform extends across another end of the base, an edge of the second platform being engagable with the lever to prevent pivoting of the lever in a second direction.

10. The switch assembly of claim 1, wherein:

the housing comprises a pair of spaced apart side walls project from opposite sides of the base, the lever arm being movable in the space between the side walls.

11. The switch assembly of claim 1, wherein:

the actuator member comprises a pair of side walls joined by a body, the side walls and the body forming the pocket.

12. The switch assembly of claim 11, wherein:

the actuator member further comprises a hollow cylindrical hub rigidly attached to the body and positioned between the side walls.

13. The switch assembly of claim 12, wherein:

a pivot pin extends through the cylindrical hub and through bores in the actuator member side walls.

14. The switch assembly of claim 12, wherein:

the cylindrical hub has end walls which are spaced apart from the side walls; and the lever body has a pair of spaced apart side walls, the cylindrical hub being mounted between the side walls of the lever.

15. A switch assembly comprising:

a housing having a base having an opening therein;

an actuator member mounted in the opening and rotatably coupled to the housing, the actuator having a body forming a pocket therein partially surrounded by a pocket wall, the pocket being open at one end thereof;

a coupling member for coupling the actuator member to electrical switch contacts;

a lever having a lever body at least partially received by the pocket, a manually operated arm projecting from the lever body and an abutment surface, the lever body being slidably and rotatably coupled to the housing, the lever body being slidable from a raised position wherein the lever body is spaced apart from the pocket wall of the pocket to a depressed position wherein the lever body engages the pocket wall;

a spring biassed to urge the lever to its raised position; and a stop member mounted on the housing, the stop member being engagable with the lever abutment surface to prevent pivoting of the lever in a first direction when the lever is in its raised position, the lever abutment surface being positioned to avoid engagement with the stop member as the lever is rotated in the first direction from its depressed position.

* * * * *